US009153852B2

(12) United States Patent
Yoshikawa et al.

(10) Patent No.: US 9,153,852 B2
(45) Date of Patent: Oct. 6, 2015

(54) COAXIAL RESONATOR, AND DIELECTRIC FILTER, WIRELESS COMMUNICATION MODULE, AND WIRELESS COMMUNICATION DEVICE EMPLOYING THE COAXIAL RESONATOR

(75) Inventors: Hiromichi Yoshikawa, Kirishima (JP); Katsuro Nakamata, Kirishima (JP); Masafumi Horiuchi, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 226 days.

(21) Appl. No.: 13/876,816

(22) PCT Filed: Sep. 29, 2011

(86) PCT No.: PCT/JP2011/072420

§ 371 (c)(1),
(2), (4) Date: Mar. 28, 2013

(87) PCT Pub. No.: WO2012/043739

PCT Pub. Date: Apr. 5, 2012

(65) Prior Publication Data

US 2013/0196608 A1 Aug. 1, 2013

(30) Foreign Application Priority Data

Sep. 29, 2010 (JP) ..... 2010-219072

(51) Int. Cl.
*H01P 7/04* (2006.01)
*H01P 1/205* (2006.01)

(52) U.S. Cl.
CPC ..... *H01P 7/04* (2013.01); *H01P 1/2053* (2013.01)

(58) Field of Classification Search
None
See application file for complete search history.

(56) References Cited

U.S. PATENT DOCUMENTS

| | | | | |
|---|---|---|---|---|
| 4,224,587 | A | 9/1980 | Makimoto et al. | |
| 4,386,328 | A | 5/1983 | Masuda et al. | 333/202 |
| 4,546,333 | A * | 10/1985 | Fukasawa et al. | 333/202 |
| 5,642,084 | A | 6/1997 | Matsumoto et al. | |

(Continued)

FOREIGN PATENT DOCUMENTS

| | | |
|---|---|---|
| EP | 0038996 A1 | 4/1981 |
| EP | 0038996 A1 | 11/1981 |

(Continued)

OTHER PUBLICATIONS

Extended European search report dated Jun. 12, 2014 issued in corresponding European application 11829292.9.

(Continued)

*Primary Examiner* — Alejandro Rivero
(74) *Attorney, Agent, or Firm* — Volpe and Koenig, P.C.

(57) ABSTRACT

A coaxial resonator includes a first outer conductor connected to a reference potential; a dielectric block which is provided with a through hole formed so as to pass therethrough from a first side surface to a second side surface opposed to the first side surface, and is so disposed that a first main surface abuts on the first outer conductor; an inner conductor disposed in an inside of the through hole; and a second outer conductor which is shaped like a rectangular box having its one face which is opened toward the first outer conductor, the second outer conductor having an inside dimension such that the dielectric block can be housed therein so as to be spaced from its second main surface, third side surface, and fourth side surface, and being connected to the reference potential.

7 Claims, 4 Drawing Sheets

(56) References Cited

U.S. PATENT DOCUMENTS

| | | | | |
|---|---|---|---|---|
| 5,764,118 | A * | 6/1998 | Saito et al. | 333/206 |
| 6,057,746 | A * | 5/2000 | Ito | 333/134 |
| 6,294,969 | B1 * | 9/2001 | Matsuo et al. | 333/206 |
| 2010/0033271 | A1 | 2/2010 | Ninomiya et al. | 333/204 |

FOREIGN PATENT DOCUMENTS

| | | | |
|---|---|---|---|
| EP | 0877433 | A1 | 11/1998 |
| EP | 1091441 | A2 | 4/2001 |
| JP | 56-15380 | | 11/1981 |
| JP | 57-048801 | | 3/1982 |
| JP | S58194403 | A | 11/1983 |
| JP | 60-145706 | | 9/1985 |
| JP | S62061504 | U | 4/1987 |
| JP | S62129807 | U | 8/1987 |
| JP | 63-023807 | | 2/1988 |
| JP | 01-227501 | | 9/1989 |
| JP | H01220501 | A | 9/1989 |
| JP | H06303004 | A | 10/1994 |
| JP | H09083212 | A | 3/1997 |
| JP | 2007150750 | A | 6/2007 |
| JP | 2008-289113 | | 11/2008 |

OTHER PUBLICATIONS

Japanese language office action dated Jan. 21, 2013 and its English language Statement of Relevance of Non-English References Pursuant to 37 CFR 1.98(a)(3)(i).

Chinese language office action dated May 6, 2014 and its English language concise explanation issued in corresponding Chinese application 201180046245.2.

* cited by examiner

COAXIAL RESONATOR, AND DIELECTRIC FILTER, WIRELESS COMMUNICATION MODULE, AND WIRELESS COMMUNICATION DEVICE EMPLOYING THE COAXIAL RESONATOR

TECHNICAL FIELD

The present invention relates to a coaxial resonator, and a dielectric filter, a wireless communication module, and a wireless communication device that employ the coaxial resonator.

BACKGROUND ART

As a resonator in which resonance occurs at a predetermined frequency, there is known a coaxial resonator composed of an inner conductor disposed in the inside of a through hole formed in a dielectric block, and an outer conductor disposed on the outside of the dielectric block (refer to Patent Literature 1, for example).

CITATION LIST

Patent Literature

Patent Literature 1: Japanese Unexamined Patent Publication JP-A 1-227501 (1989)

SUMMARY OF THE INVENTION

Technical Problem

However, the conventional coaxial resonator as proposed in Patent Literature 1 has difficulty in achieving both a rise in Q value in the first resonant mode and a widening of the gap in resonant frequency between the first resonant mode and the second resonant mode. Note that the first resonant mode refers to, among a multiplicity of coaxial resonator's resonant modes, a resonant mode of the lowest resonant frequency, whereas the second resonant mode refers to a resonant mode of the second lowest resonant frequency. In general, the first resonant mode of coaxial resonators is utilized, wherefore a rise in Q value in the first resonant mode involves improvements in the electrical characteristics of coaxial resonators. Moreover, it is desirable that the second resonant mode corresponding to a spurious mode is apart in respect of frequency from the first resonant mode.

The invention has been devised in view of the problem associated with the conventional art as mentioned supra, and accordingly an object thereof is to provide a coaxial resonator having a high Q value in the first resonant mode and a wide resonant frequency gap between the first resonant mode and the second resonant mode, as well as to provide a dielectric filter, a wireless communication module, and a wireless communication device that employ the coaxial resonator.

Solution to Problem

A coaxial resonator according to the invention comprises: a first outer conductor connected to a reference potential; a dielectric block which is a dielectric body having a rectangular parallelepiped shape, the dielectric block being provided with a through hole formed so as to pass therethrough from a first side surface to a second side surface opposed to the first side surface of the dielectric block, and being so disposed that a first main surface of the dielectric block abuts on the first outer conductor; an inner conductor disposed in an inside of the through hole; and a second outer conductor which is shaped like a rectangular box having its one face which is opened toward the first outer conductor, the second outer conductor having an inside dimension such that the dielectric block can be housed therein so as to be spaced from its second main surface, third side surface, and fourth side surface, and being connected to the reference potential.

Moreover, a dielectric filter according to the invention includes: the above-mentioned coaxial resonator including a plurality of the inner conductors, the inner conductors being spaced apart in a row in a direction from the third side surface to the fourth side surface; and terminal electrodes electrically or electromagnetically connected to an inner conductor on a third side surface side and an inner conductor on a fourth side surface side, respectively, the inner conductor on the third side surface side and the inner conductor on the fourth side surface side each being an endmost conductor of the row.

Further, a wireless communication module according to the invention includes: an RF section including the above-mentioned dielectric filter; and a baseband section connected to the RF section.

Still further, a wireless communication device according to the invention includes: the above-mentioned wireless communication module; and an antenna connected to the RF section of the wireless communication module.

Advantageous Effects of Invention

According to the coaxial resonator of the invention, it is possible to obtain a coaxial resonator having a high Q value in the first resonant mode and a wide resonant frequency gap between the first resonant mode and the second resonant mode.

Moreover, according to the dielectric filter of the invention, since a bandpass filter is constructed by using the above-mentioned coaxial resonator having a high Q value in the first resonant mode and a wide resonant frequency gap between the first resonant mode and the second resonant mode, it follows that the dielectric filter excels in frequency selectivity with the advantages of low losses and the absence of spurious components in the vicinity of a pass band.

Further, according to the wireless communication module and the wireless communication device of the invention, since wave filtering is performed on communication signals by using the above-mentioned dielectric filter having low losses and excellent frequency selectivity, it is possible to decrease attenuation and noise of communication signals, and thereby allow the wireless communication module and the wireless communication device to have high-quality communication performance capability and high reliability.

DESCRIPTION OF EMBODIMENTS

Hereinafter, a coaxial resonator of the present embodiment will be described in detail with reference to the accompanying drawings.

First Embodiment

Figure 1:
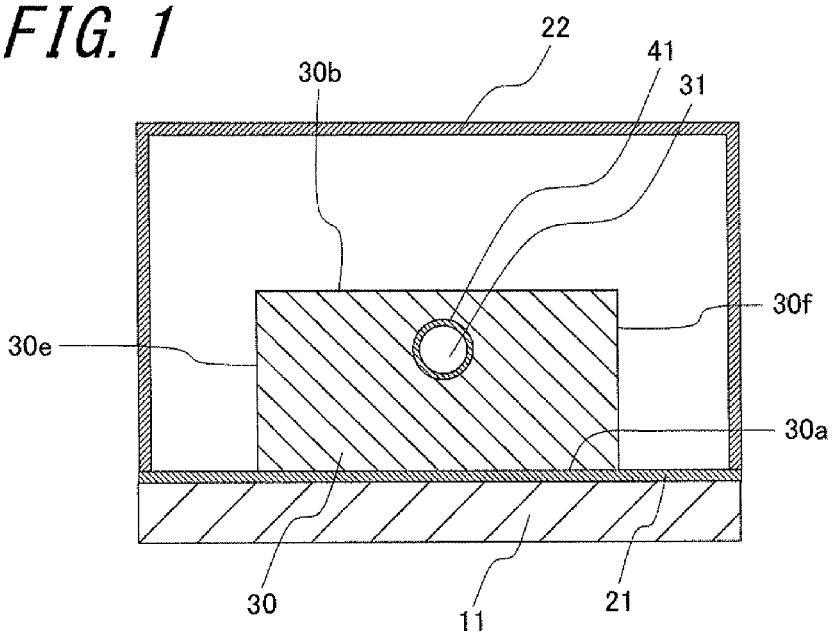
FIG. 1 is a transverse sectional view schematically showing a coaxial resonator in accordance with a first embodiment of the invention.
Figure 2:
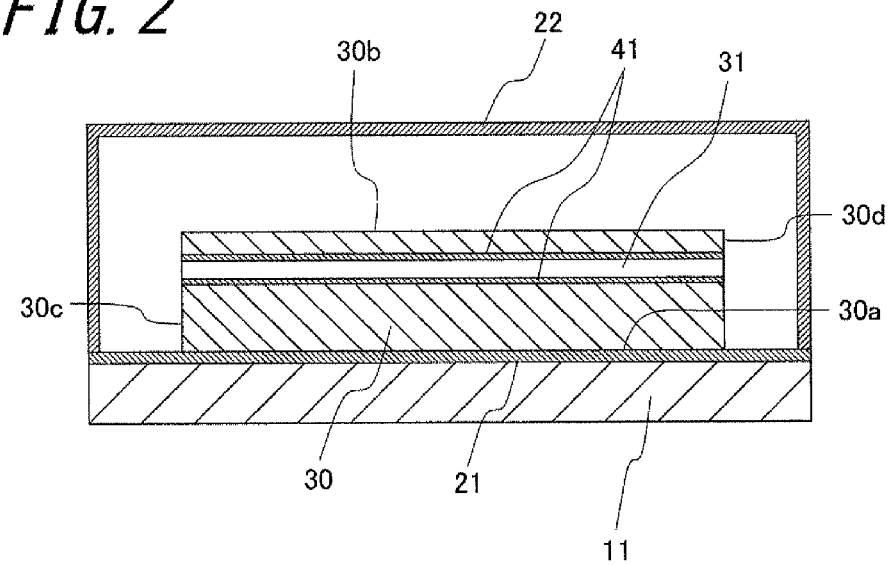
FIG. 2 is a schematic longitudinal sectional view of the coaxial resonator shown in FIG. 1.

FIG. 1 is a transverse sectional view schematically showing a coaxial resonator in accordance with a first embodiment of the invention. FIG. 2 is a schematic longitudinal sectional view of the coaxial resonator shown in FIG. 1.

As shown in FIGS. 1 and 2, the coaxial resonator of this embodiment includes a first outer conductor 21, a second outer conductor 22, a dielectric block 30, and an inner conductor 41, and the coaxial resonator is placed on a main surface of a plate-like dielectric substrate 11.

The first outer conductor 21, which is a sheet-like conductor placed on the main surface of the dielectric substrate 11, is connected to a reference potential (ground potential).

The dielectric block 30, which is a dielectric body having a rectangular parallelepiped shape, is provided with a through hole 31 formed so as to pass therethrough from a first side surface 30*c* to a second side surface 30*d* opposed to the first side surface 30*c* of the dielectric block, and is so disposed that a first main surface 30*a* of the dielectric block 30 abuts on the first outer conductor 21. Note that the term "rectangular parallelepiped shape" is construed as encompassing the shape of a hexahedron with six rectangular faces having, for example, a protrusion or recess formed in part of one specific face thereof. Moreover, the inner conductor 41 is disposed in the inside of the through hole 31.

The second outer conductor 22 is a conductor shaped like a rectangular box having its one face which is opened, has an inside dimension such that the dielectric block 30 can be housed therein so as to be spaced from its second main surface 30*b*, third side surface 30*e*, and fourth side surface 30*f*. The second outer conductor 22 is, upon being placed so that its opening points toward the first outer conductor 21, connected to the first outer conductor 21 and is thereby connected to a reference potential (ground potential). The first outer conductor 21 and the second outer conductor 22 are positioned so as to surround the dielectric block 30 for serving as the outer conductor of the coaxial resonator. Moreover, in the case shown in FIG. 2, the first side surface 30*c* and the second side surface 30*d* are also spaced from the second outer conductor 22, but, so long as the inner conductor 41 has its one end connected to a reference potential, the second outer conductor 22 can be placed in contact with the first or second side surface 30*c* or 30*d* at which the inner conductor 41 is connected to a reference potential. Note that the space between the dielectric block 30 and the second outer conductor 22 is filled with air.

According to the coaxial resonator having such constitution of this embodiment, since a spacing is secured between the second outer conductor 22 which serves as part of the outer conductor of the coaxial resonator and each of the second main surface 30*b*, the third side surface 30*e*, and the fourth side surface 30*f* of the dielectric block 30, it follows that a low-dielectric-constant portion which is lower in dielectric constant than the dielectric block 30 is created between them. This makes it possible to decrease the effective dielectric constant in between the second outer conductor 22 serving as part of the outer conductor and the inner conductor 41 and thereby equalize the resonant frequency of the first resonant mode, and therefore, in contrast to a coaxial resonator in which the second outer conductor 22 is disposed so as not to be spaced from each of the second main surface 30*b*, the third side surface 30*e*, and the fourth side surface 30*f* of the dielectric block 30; that is, disposed so as to cover each of them, a rise in Q value in the first resonant mode, as well as a widening of the gap in resonant frequency between the first resonant mode and the second resonant mode, can be achieved.

Moreover, according to the coaxial resonator of this embodiment, the first main surface 30*a* of the dielectric block 30 is abutted on the first outer conductor 21, which allows the coaxial resonator to feature structural simplicity and ease of manufacture.

Further, according to the coaxial resonator of this embodiment, it is preferable that the inner conductor 41 is so disposed that its center is situated closer to the second main surface 30*b* beyond a position midway between the first main surface 30*a* and the second main surface 30*b*. That is, in the case of locating the inner conductor 41 closer to the second main surface 30*b*, in contrast to a case where the inner conductor 41 is located centrally of the dielectric block or located closer to the first main surface 30*a*, in the range between the first main surface 30*a* and the second main surface 30*b*, it is possible to increase the spaced interval between the inner conductor 41 and the first outer conductor 21, and thereby achieve both a further rise in Q value in the first resonant mode and a further widening of the gap in resonant frequency between the first resonant mode and the second resonant mode.

Although it is preferable to increase the spaced interval between the second outer conductor 22 and each of the second main surface 30*b*, the third side surface 30*e*, and the fourth side surface 30*f* of the dielectric block 30 in the interest of improvement in electrical characteristics, an increase in the spaced interval may cause the coaxial resonator to grow in size, and therefore the spaced interval should preferably be adjusted properly with consideration given to the required electrical characteristics and the permissible outer dimension of the coaxial resonator.

Second Embodiment

Figure 3:
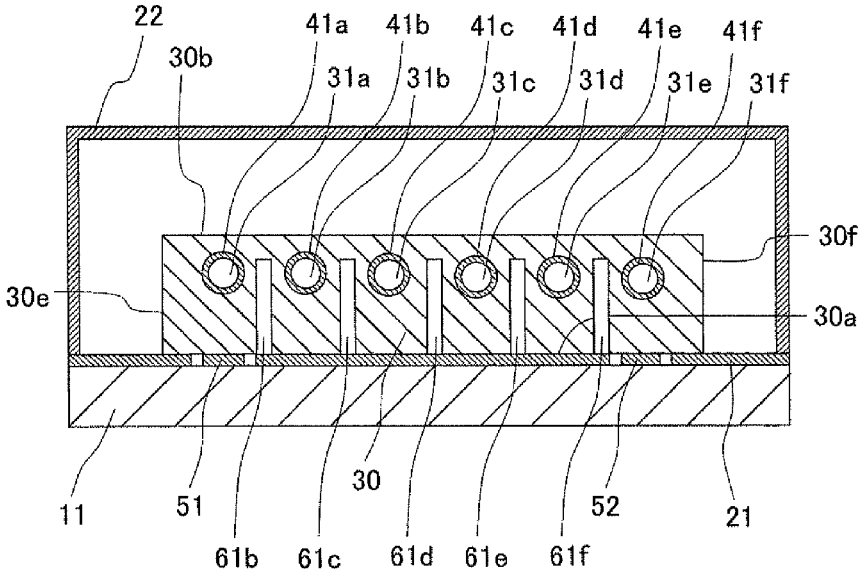
FIG. 3 is a transverse sectional view schematically showing a dielectric filter in accordance with a second embodiment of the invention.
Figure 4:
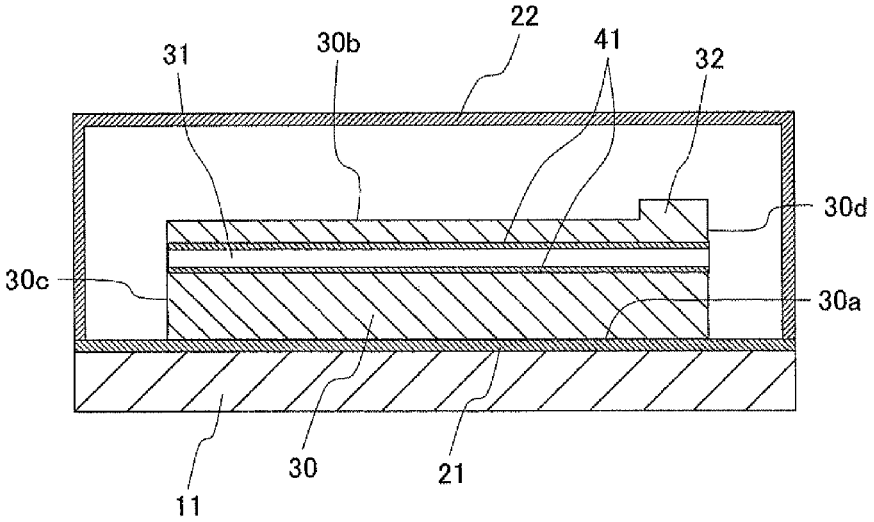
FIG. 4 is a schematic longitudinal sectional view of the dielectric filter shown in FIG. 3.

FIG. 3 is a transverse sectional view schematically showing a dielectric filter in accordance with a second embodiment of the invention. FIG. 4 is a schematic longitudinal sectional view of the dielectric filter shown in FIG. 3. Note that the following description deals only with the points of difference from the preceding embodiment, and such constituent components as are common to those of the preceding embodiment will be identified with the same reference symbols, and overlapping descriptions will be omitted.

As shown in FIG. 3, the dielectric filter of this embodiment includes: a row of inner conductors 41*a* through 41*f* spaced apart in a direction from the third side surface 30*e* to the fourth side surface 30*f* of the dielectric block 30; and a first terminal electrode 51 and a second terminal electrode 52 electrically or electromagnetically connected to the inner conductor 41*a* which is one of the endmost conductors of the row located at the side of the third side surface, or the inner conductor 41*a* on the third side surface side, and the inner conductor 41*f* which is the other one of the endmost conductors of the row located at the side of the fourth side surface, or the inner conductor 41*f* on the fourth side surface side, respectively.

It is noted that, in this embodiment, a structure including the outer conductor composed of the first outer conductor 21 and the second outer conductor 22, and one of a plurality of inner conductors 41 arranged in the dielectric block 30, for example, the inner conductor 41*a*, fulfills the conditions for constituting a coaxial resonator, and therefore, in the following description, a construction including a plurality of inner conductors 41*a* through 41*f* having a common outer conductor is assumed to have a plurality of coaxial resonators. That is, in FIG. 3, there are provided six coaxial resonators.

In the dielectric filter shown in FIG. 3, a plurality of coaxial resonators formed by arranging a plurality of inner conductors 41*a* through 41*f* having a common outer conductor are electromagnetically coupled to each other.

Moreover, on the second side surface 30*d* of the dielectric block 30, a capacitive coupling electrode (not shown) is disposed for each of the inner conductors 41*a* through 41*f*. A predetermined electrostatic capacitance is formed between the adjacent capacitive coupling electrodes for strengthening the electromagnetic coupling between the adjacent coaxial resonators. Further, at the first side surface 30*c* of the dielectric block 30, slits 61*b* through 61*f* are formed so as to lie between their respective adjacent ones of the inner conductors 41*a* through 41*f*.

Moreover, the first terminal electrode 51 is located below the inner conductor 41*a* on the third side surface side, and lies across the first side surface 30*c* and the first main surface 30*a* of the dielectric block 30 while being kept out-of-contact with the first outer conductor 21. Thus, the first terminal electrode 51 is electromagnetically connected to the inner conductor 41*a* on the third side surface side.

On the other hand, the second terminal electrode 52 is located below the inner conductor 41 on the fourth side surface side, and lies across the first side surface 30*c* and the first main surface 30*a* of the dielectric block 30 while being kept out-of-contact with the first outer conductor 21. Thus, the second terminal electrode 52 is electromagnetically connected to the inner conductor 41 on the fourth side surface side.

In the dielectric filter having such constitution of this embodiment, upon the input of an electric signal to, for example, the first terminal electrode 51, then resonance occurs in the plurality of coaxial resonators formed of the inner conductors 41*a* through 41*f* and the outer conductor consisting of the first outer conductor 21 and the second outer conductor 22, whereupon output of electric signal is produced from the second terminal electrode 52. At that time, with the selective passage of signals lying in a frequency band including the resonant frequencies of the plurality of coaxial resonators, the dielectric filter functions as a bandpass filter. Thus, the dielectric filter of this embodiment is constructed by forming a plurality of coaxial resonators of the first embodiment as described previously, and a bandpass filter can be implemented by establishing electromagnetic coupling between the plurality of coaxial resonators.

According to the dielectric filter having such constitution of this embodiment, the coaxial resonators having a high Q value in the first resonant mode and a wide resonant frequency gap between the first resonant mode and the second resonant mode are used to fabricate a bandpass filter, wherefore the dielectric filter has excellent frequency selectivity with the advantages of low losses and the absence of spurious components in the vicinity of the pass band.

Moreover, in the dielectric filter of this embodiment, the dielectric block 30 has a protrusion 32. The protrusion 32 has its surface made continuous with the second side surface 30*d*, the third side surface 30*e*, and the fourth side surface 30*f*. The protrusion 32 alone has a rectangular parallelepiped shape, and is formed on the second main surface 30*b* of the dielectric block 30 so as to be situated closer to the second side surface 30*d*.

There may be cases where a secondary resonant mode of the coaxial resonator constituting the dielectric filter of this embodiment is not a λ mode which is a normal high-order mode for coaxial resonators but a so-called cavity mode. In this case, the magnitude of an electric field in the secondary resonant mode is, in a direction from the first side surface 30*c* to the second side surface 30*d* of the dielectric block 30, greater in the middle region yet is smaller at both end regions. On the other hand, the magnitude of an electric field in a primary resonant mode of the coaxial resonator constituting the dielectric filter of this embodiment is, in the direction from the first side surface 30*c* to the second side surface 30*d*, zero in the middle region yet rises to a maximum at both end regions in the form of open ends.

It is therefore preferable to shape the dielectric block 30 so that, in the direction from the first side surface 30*c* to the second side surface 30*d*, at least one of the end located on the first side surface 30*c* side and the end located on the second side surface 30*d* side, is greater than the midportion thereof in respect of the distance between the first main surface 30*a* and the second main surface 30*b*.

Thus, in the case where, just as with the dielectric filter of this embodiment, the dielectric block 30 has the protrusion 32, the dielectric block 30 takes on the configuration in which, in the direction from the first side surface 30*c* to the second side surface 30*d*, a distance between the first main surface 30*a* and the second main surface 30*b* at one of the opposite ends of the dielectric block is greater than a distance between the first main surface 30*a* and the second main surface 30*b* at the midportion of the dielectric block 30. This makes it possible to widen the gap in resonant frequency between the primary resonant mode and the secondary resonant mode, as well as to strengthen the electromagnetic coupling between the adjacent coaxial resonators.

Moreover, when the secondary resonant mode of the coaxial resonator constituting the dielectric filter of this embodiment is the cavity mode, an electric field in the secondary resonant mode is, in the direction from the first side surface 30*c* to the second side surface 30*d* of the dielectric block 30, highest in intensity in the middle region, yet is weakened gradually from the middle region to each end region and eventually becomes zero at a certain point. That is, the electric field at each end region is weak inversely with that at the middle region. The point at which the electric field becomes zero exists within the range from each end to a point spaced therefrom by a distance equivalent to a quarter of the entire length between the first side surface 30*c* and the second side surface 30*d*. Accordingly, it is desirable that, in the dielectric block 30, in the direction from the first side surface 30*c* to the second side surface 30*d*, that part thereof, which lies within the range from at least one of the opposite ends to a point spaced therefrom by a distance equivalent to a quarter of the length between the first side surface 30*c* and the second side surface 30*d*, is greater in the distance between the first main surface 30*a* and the second main surface 30*b* than the midportion thereof.

Moreover, in the dielectric filter of this embodiment, the dielectric block 30 is formed with the slits 61*b* through 61*f*.

Also by virtue of the slits 61*b* through 61*f*, it is possible to achieve both a rise in Q value in the primary resonant mode and a widening of the gap in resonant frequency between the primary resonant mode and the secondary resonant mode. In addition, the provision of the slits 61*b* through 61*f* allows adjustment to the electromagnetic coupling between the adjacent resonators. Note that, in the case of forming the slits 61*b* through 61*f* only at the first side surface 30*c* or the second side surface 30*d*, capacitive coupling can be readily established between coaxial resonators at the side surface free from the slits 61*b* through 61*f*, whereas, in the case of forming the slits 61*b* through 61*f* so as to extend across the first side surface 30*c* and the second side surface 30*d*, it is possible to achieve both a further rise in Q value in the primary resonant mode and a further widening of the gap in resonant frequency between the primary resonant mode and the secondary resonant mode.

In the dielectric filter of this embodiment, and in the above-mentioned coaxial resonator of the first embodiment as well, as the material of construction of the dielectric block 30, a resin material such as epoxy resin and a ceramic material such for example as a ceramic dielectric can be used. For example, a dielectric ceramic material containing $BaTiO_3$, $Pb_4Fe_2Nb_2O_{12}$, $TiO_2$, etc. can be preferably used. As the material of construction of various electrodes and conductors, for example, an electrically conductive material composed predominantly of Ag or a Ag alloy such as Ag—Pd or Ag—Pt, a Cu-based conductive material, a W-based conductive material, a Mo-based conductive material, a Pd-based conductive material, and so forth are preferably used. The thickness of each of the electrodes and conductors is adjusted to fall in a range from 0.001 mm to 0.2 mm, for example.

Third Embodiment

Figure 5:
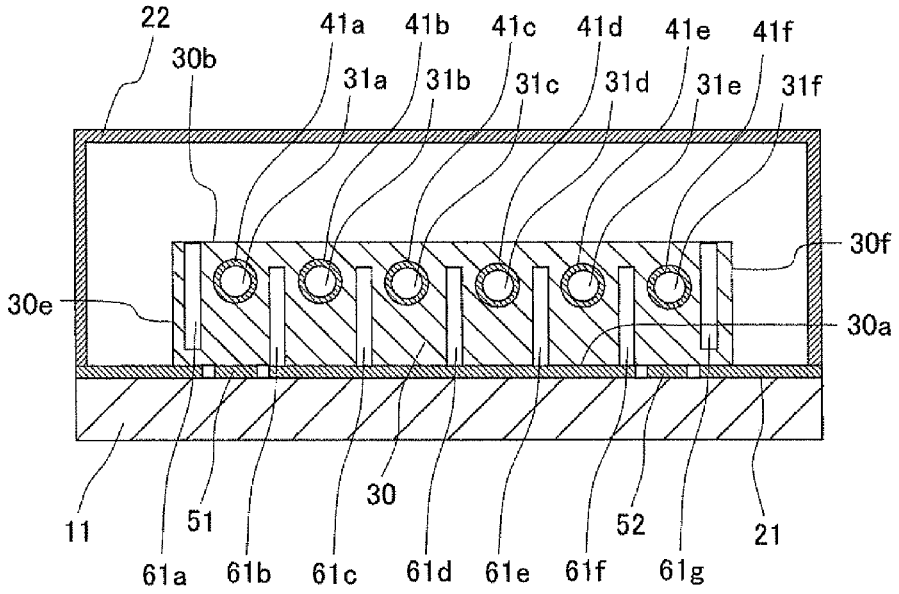
FIG. 5 is a transverse sectional view schematically showing a dielectric filter in accordance with a third embodiment of the invention.

FIG. 5 is a transverse sectional view schematically showing a dielectric filter in accordance with a third embodiment of the invention. The dielectric filter of this embodiment includes, in addition to the constituents of the dielectric filter shown in FIG. 3, a slit 61*a* and a slit 61*g* that are disposed between the inner conductor 41*a* on the third side surface side and the third side surface 30*c*, and between the inner conductor 41*f* on the fourth side surface and the fourth side surface 30*d*, respectively. In such a configuration, the Q value of the first resonant mode of the coaxial resonator constituting a bandpass filter is further raised, and the gap in resonant frequency between the first resonant mode and the second resonant mode is further widened, wherefore the dielectric filter has more excellent frequency selectivity with the advantages of low losses and the absence of spurious components in the vicinity of the pass band.

In order to attain the effects as above described, it is preferable to form the slit 61*a*, 61*g* between the inner conductor 41*a* on the third side surface and the third side surface 30*c* or between the inner conductor 41*f* on the fourth side surface and the fourth side surface 30*d* in proximity to the inner conductor 41*a* on the third side surface or the inner conductor 41*f* on the fourth side surface. Moreover, in the case shown in FIG. 5 where the slit 61*a*, 61*g* is opened at the second main surface 30*b*, in the interest of attaining the above-described effects, it is preferable that the slit 61*a*, 61*g* has a certain depth in a direction from the second main surface 30*b* to the first main surface 30*a* so that it can be located as close to the first outer conductor 21 as possible. It is needless to say that, like the slits 61*b* through 61*f*, the slit 61*a*, 61*g* may be opened on the first main surface 30*a* side.

Figure 6:
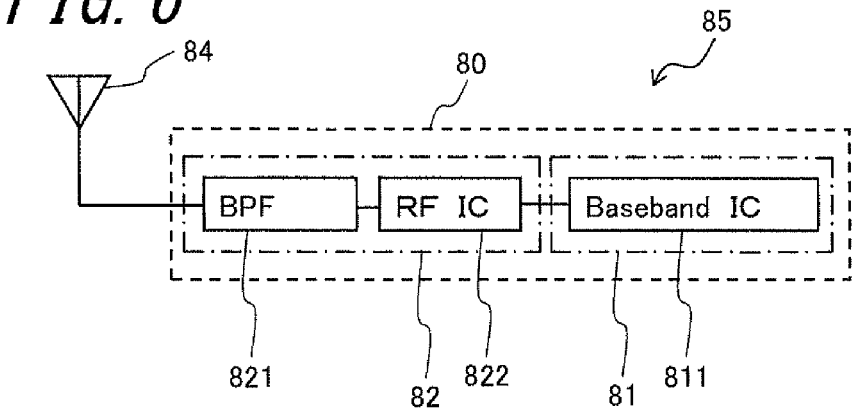
FIG. 6 is a block diagram schematically showing a wireless communication module and a wireless communication device in accordance with a fourth embodiment of the invention.

Next, FIG. 6 is a block diagram schematically showing a wireless communication module 80 and a wireless communication device 85 in accordance with a fourth embodiment of the invention.

The wireless communication module 80 of this embodiment comprises: a baseband section 81 configured to process baseband signals; and an RF section 82 connected to the baseband section 81, configured to process RF signals obtained after modulation and before demodulation of baseband signals. The RF section 82 includes a dielectric filter 821 based on the above-mentioned second embodiment, so that, out of RF signals resulting from modulation of baseband signals or received RF signals, those that lie outside the communication band are attenuated by the dielectric filter 821.

As specific configuration, the baseband section 81 includes a baseband IC 811. Moreover, the RF section 82 includes an RF IC 822 connected between the dielectric filter 821 and the baseband section 81. Note that another circuit may be interposed between these circuits. Upon connecting an antenna 84 to the dielectric filter 821 of the wireless communication module 80, construction of the wireless communication device 85 of this embodiment capable of transmission and reception of RF signals can be completed.

According to the wireless communication module 80 and wireless communication device 85 having such constitution of this embodiment, since wave filtering is performed on communication signals with use of the dielectric filter 821 having low losses and excellent frequency selectivity, it is possible to decrease attenuation and noise of communication signals, and thereby obtain a wireless communication module 80 and wireless communication device 85 having high-quality communication performance capability.

MODIFIED EXAMPLES

It should be understood that the application of the invention is not limited to the specific embodiments described heretofore, and that various changes and modifications are possible without departing from the spirit and scope of the invention.

While the first to third embodiments have been described with respect to the case where the inner conductor is opened at both ends thereby constituting a half-wavelength resonator, it does not constitute any limitation. The invention may be implemented as a coaxial resonator with an inner conductor which is connected to a reference potential at one end thereby constituting a quarter-wavelength resonator, and a dielectric filter using the coaxial resonator.

Moreover, while the first to third embodiments have been described with respect to the case where the space between the dielectric block 30 and the second outer conductor 22 is filled with air, it does not constitute any limitation. For example, a vacuum may be created in the space between the dielectric block 30 and the second outer conductor 22, or the space between the dielectric block 30 and the second outer conductor 22 may be filled with a dielectric material (including air) which is lower in dielectric constant than the dielectric block 30.

Moreover, while the dielectric filter of the second embodiment has been described with respect to the case where the dielectric block 30 has the protrusion 32 which is situated closer to the second side surface 30*d*, it does not constitute any limitation. For example, the dielectric block 30 may have a protrusion 32 which is situated closer to the first side surface 30*c*, or the dielectric block 30 may have protrusions 32 that are situated closer to the first side surface 30*c* and the second side surface 30*d*, respectively. Further, in a case where the level of required electrical characteristics is not so high, instead of forming the protrusion 32 as shown in FIG. 4, for example, the dielectric block 30 may be shaped so that the distance between the first main surface 30*a* and the second main surface 30*b* becomes longer gradually toward a direction from the midportion to at least one of the first side surface 30*c* and the second side surface 30*d*. In this way, the dielectric block 30 is preferably so designed that, in the direction from the first side surface 30*c* to the second side surface 30*d*, a distance between the first main surface 30*a* and the second main surface 30*b* at least one of the opposite ends is greater than a distance between the first main surface 30*a* and the second main surface 30*b* at the midportion of the dielectric block 30.

Moreover, while the dielectric filter of the second and third embodiments has been described with respect to the case where there are provided six coaxial resonators by using the outer conductor consisting of the first outer conductor 21 and the second outer conductor 22 and the inner conductors 41*a* through 41*f* disposed in the insides of the through holes 31*a* through 31*f*, respectively, it does not constitute any limitation, and it is therefore possible to constitute a dielectric filter by using any number, for example two or more, of coaxial resonators. However, in general, the number of coaxial resonators is preferably less than or equal to about 20, because an increase in the number of coaxial resonators leads to an increase in size.

In addition, while the dielectric filter of the second and third embodiments has been described with respect to the case where the first and second terminal electrodes 51 and 52 are electromagnetically connected to the inner conductors 41*a* and 41*f*, respectively, the first and second terminal electrodes 51 and 52 may be electrically connected to the inner conductors 41*a* and 41*f*, respectively.

EXAMPLES

Next, concrete examples of the coaxial resonator of the present embodiment will be described.

Firstly, the electrical characteristics of the coaxial resonator of the first embodiment shown in FIGS. 1 and 2 have been determined by calculation through a simulation using the finite element method. The resonant frequency and noload Q of the first resonant mode and the resonant frequency of the second resonant mode were selected as target electrical characteristics to be determined.

In the dielectric body constituting the dielectric block 30 used in the simulation, the relative permittivity was 10, and the dielectric tangent was 0.0005. Moreover, the electrical conductivity of each of various conductors and electrodes was $58\times10^6$ S/m. The dielectric block 30 was given a rectangular parallelepiped shape which was 13 mm in height (the distance from the first main surface 30*a* to the second main surface 30*b*) and in width (the distance from the third side surface 30*e* to the fourth side surface 30*f*), and 28 mm in length (the distance from the first side surface 30*c* to the second side surface 30*d*). Further, the through hole 31 was given a cylindrical shape which was 3 mm in diameter, and, the center of the through hole 31 was spaced by a distance of 10 mm away from the first main surface 30*a*, and was located centrally between the third side surface 30*e* and the fourth side surface 30*f*. The inner conductor 41 was placed in the inside of the through hole 31. In addition, the first outer conductor 21 was given a rectangular shape which was 38 mm in length and 20 mm in width, and the dielectric block 30 was situated in the middle of the first outer conductor 21. The second outer conductor 22 was shaped like a rectangular box having its one face which is opened, which was 38 mm in length and 20 mm in width and in height.

According to the result of the simulation, the resonant frequency of the first resonant mode was 2.05 GHz; the Q value thereof was 1450; and the resonant frequency of the second resonant mode was 3.6 GHz. Moreover, a simulation was conducted as to the electrical characteristics of a coaxial resonator of a comparative example in which an inner conductor having a diameter of 3 mm and a length of 23 mm was disposed centrally of a dielectric block which was 23 mm in length and 20 mm in width and height, and this dielectric block was placed in the middle of an outer conductor having a space which was 33 mm in length and 20 mm in width and height in the direction of the length thereof. According to the result of the simulation, the resonant frequency of the first resonant mode was 1.99 GHz; the Q value thereof was 1319; and the resonant frequency of the second resonant mode was 2.7 GHz. Thus, the coaxial resonator of the first embodiment had a high Q value of the primary resonant mode than the coaxial resonator of the comparative example. Moreover, the coaxial resonator of the first embodiment, although it was nearly equal to the coaxial resonator of the comparative example in respect of the resonant frequency of the primary resonant mode, is higher than the coaxial resonator of the comparative example in respect of the resonant frequency of the secondary resonant mode; that is, there was a wide gap in resonant frequency between the first resonant mode and the second resonant mode.

Accordingly, it has been confirmed that the coaxial resonator can be obtained that includes: the first outer conductor 21 connected to a reference potential; the dielectric block 30 which is a dielectric body having a rectangular parallelepiped shape, is provided with the through hole 31 formed so as to pass therethrough from the first side surface 30*c* to the second side surface 30*d* opposed to the first side surface 30*c*, and is so disposed that its first main surface 30*a* abuts on the first outer conductor 21; the inner conductor 41 disposed in the inside of the through hole 31; and the second outer conductor 22 which is shaped like a rectangular box having its one face which is opened toward the first outer conductor 21, has an inside dimension such that the dielectric block 30 can be housed therein so as to be spaced from its second main surface 30*b*, third side surface 30*e*, and fourth side surface 30*f*, and is connected to a reference potential, and thus, wherein, the Q value in the first resonant mode is high and a gap in resonant frequency between the first resonant mode and the second resonant mode is wide.

Next, the electrical characteristics of the dielectric filter of the second embodiment shown in FIGS. 3 and 4 have been determined by calculation through a simulation using the finite element method. In the dielectric body constituting the dielectric block 30 used in the simulation, the relative permittivity was 11.5 and the dielectric tangent was 0.00005. Moreover, the electrical conductivity of each of various conductors and electrodes was $42\times10^6$ S/m.

Where the dimension of the dielectric block 30 excluding the protrusion 32 is concerned, the height, viz., the distance from the first main surface 30*a* to the second main surface 30*b* was 8.5 mm; the width, viz., the distance from the third side surface 30*e* to the fourth side surface 30*f* was 56 mm; and the length, viz., the distance from the first side surface 30*c* to the second side surface 30*d* was 23.7 mm. Moreover, the protrusion 32 has its surface made continuous with the second side surface 30*d*, the third side surface 30*e*, and the fourth side surface 30*f* of the dielectric block 30, and the protrusion 32 alone was given a rectangular parallelepiped shape. Where the dimension of the protrusion 32 is concerned, the height from the second main surface 30*b* was 2 mm; the length in the direction from the first side surface 30*c* to the second side surface 30*d* was 4 mm; and the width, viz., the distance from the third side surface 30*e* to the fourth side surface 30*f* was 56 mm.

Moreover, the through holes 31*a* through 31*f* were each given a cylindrical shape which was 3 mm in diameter, and, the center of each of the through holes 31*a* through 31*f* was spaced by a distance of 5 mm away from the first main surface 30*a*. These through holes 31 were so arranged that their centers are spaced equidistantly, and the inner conductor 41 was placed in the inside of each of the through holes 31. Further, the slits 61*b* through 61*f* formed so as to lie between their respective adjacent ones of the inner conductors 41*a* through 41*f* were each 1.0 mm in width, and 7.5 mm in depth in the direction from the first main surface 30*a* to the second main surface 30*b*. In addition, the first outer conductor 21 was given a rectangular shape which was 31.7 mm in length and 62 mm in width, and the dielectric block 30 was situated in the middle of the first outer conductor 21. The second outer conductor 22 was shaped like a rectangular box having its one face which is opened, which was 31.7 mm in length, 62 mm in width, and 15 mm in height.

Figure 7:
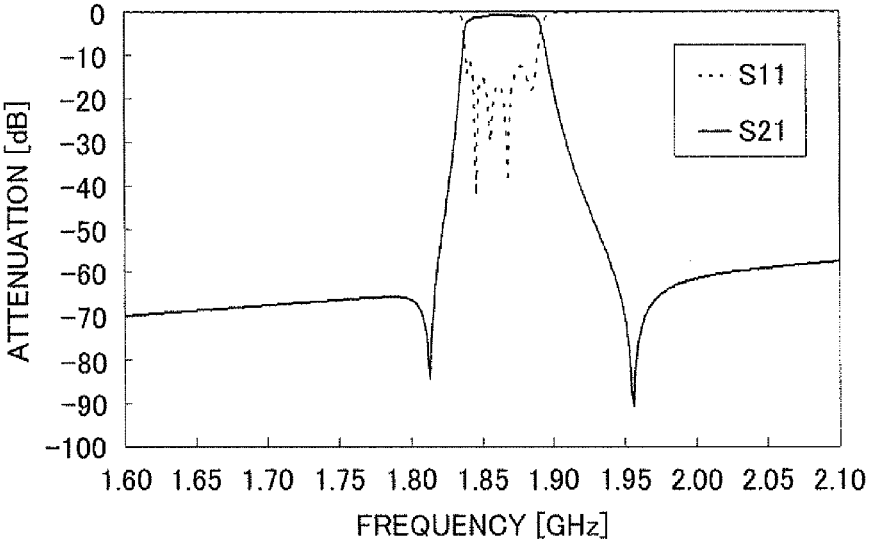
FIG. 7 is a graph showing a result of the simulation of the electrical characteristics of the dielectric filter in accordance with a second embodiment of the invention.

The result of the simulation was shown in the graph of FIG. 7. In the graph, the abscissa axis represents frequency, and the ordinate axis represents attenuation. Moreover, the solid line represents transmission characteristics, and the broken line represents reflection characteristics. The graph showed that excellent transmission characteristics were obtained in the absence of spurious component in the vicinity of the pass band; that is, it has been confirmed that the dielectric filter of this embodiment excels in frequency selectivity.

Next, the electrical characteristics of the dielectric filter of the second and third embodiments shown in FIGS. 3 and 5 have been determined by calculation through a simulation using the finite element method. In the dielectric body constituting the dielectric block 30 used in the simulation, the relative permittivity was 11.5 and the dielectric tangent was 0.00005. Moreover, the electrical conductivity of each of various conductors and electrodes was $42\times10^6$ S/m.

Where the dimension of the dielectric block 30 excluding the protrusion 32 is concerned, the height, viz., the distance from the first main surface 30*a* to the second main surface 30*b* was 9.5 mm; the width, viz., the distance from the third side surface 30*e* to the fourth side surface 30*f* was 56 mm; and the length, viz., the distance from the first side surface 30*c* to the second side surface 30*d* was 23.7 mm. Moreover, the protrusion 32 had its surface made continuous with the second side surface 30*d*, the third side surface 30*e*, and the fourth side surface 30*f* of the dielectric block 30, and the protrusion 32 alone was given a rectangular parallelepiped shape. Where the dimension of the protrusion 32 is concerned, the height from the second main surface 30*b* was 4.2 mm; the length in the direction from the first side surface 30*c* to the second side surface 30*d* was 4 mm; and the width, viz., the distance from the third side surface 30*e* to the fourth side surface 30*f* was 56 mm.

Moreover, the through holes 31*a* through 31*f* were each given a cylindrical shape which was 3 mm in diameter, and, the center of each of the through holes 31*a* through 31*f* was spaced by a distance of 5 mm away from the first main surface 30*a*. The through holes 31*a* through 31*f* were so arranged that their centers are spaced equidistantly, and the inner conductor 41 was placed in the inside of each of the through holes 31. Further, the slits 61*b* through 61*f* formed so as to lie between their respective adjacent ones of the inner conductors 41*a* through 41*f* were each 1.0 mm in width, and 7.5 mm in depth in the direction from the first main surface 30*a* to the second main surface 30*b*. Still further, the first outer conductor 21 was given a rectangular shape which was 31.7 mm in length and 62 mm in width, and the dielectric block 30 was situated in the middle of the first outer conductor 21. The second outer conductor 22 was shaped like a rectangular box having its one face which is opened, which was 31.7 mm in length, 62 mm in width, and 15 mm in height. In addition, in the dielectric filter of the third embodiment shown in FIG. 5, the dielectric block 30 was formed with the slit 61*a* located between the inner conductor 41*a* on the third side surface and the third side surface 30*c*, and the slit 61*g* located between the inner conductor 41*f* on the fourth side surface and the fourth side surface 30*d*. The slits 61*a* and 61*g* were each 2.5 mm in width, and 6.5 mm in depth in the direction from the second main surface 30*b* to the first main surface 30*a*.

According to the result of the simulation, in the dielectric filter of the second embodiment shown in FIG. 3, the resonant frequency of the first resonant mode was 1.874 GHz; the Q value thereof was 2037; and the resonant frequency of the second resonant mode was 2.780 GHz. On the other hand, in the dielectric filter of the third embodiment shown in FIG. 5, the resonant frequency of the first resonant mode was 1.874 GHz; the Q value thereof was 2063; and the resonant frequency of the second resonant mode was 2.895 GHz.

It has been found out from the result that, in the dielectric block 30, the provision of the slit 61*a* between the inner conductor 41*a* on the third side surface and the third side surface 30*c*, as well as the provision of the slit 61*g* between the inner conductor 41*f* on the fourth side surface and the fourth side surface 30*d*, allows both a further rise in Q value in the first resonant mode and a further widening of the gap in resonant frequency between the first resonant mode and the second resonant mode. Accordingly, it has been found out that the dielectric filter having the above-mentioned constitution affords more excellent frequency selectivity.

Moreover, since the dielectric filter of this embodiment has low losses and excellent frequency selectivity, it is possible to reduce attenuation and noise of communication signals through wave filtering on the communication signals, and it has thus been found out that, in the case of utilizing the dielectric filter of this embodiment for a wireless communication module and a wireless communication device, it is possible to allow the wireless communication module and the wireless communication device to have high-quality communication performance capability and high reliability.

REFERENCE SIGNS LIST

21: First outer conductor
22: Second outer conductor
30: Dielectric block
30*a*: First main surface
30*b*: Second main surface
30*c*: First side surface
30*d*: Second side surface
30*e*: Third side surface
30*f*: Fourth side surface
31, 31*a*, 31*b*, 31*c*, 31*d*, 31*e*, 31*f*: Through hole
41, 41*a*, 41*b*, 41*c*, 41*d*, 41*e*, 41*f*: Inner conductor
51: First terminal electrode
52: Second terminal electrode
80: Wireless communication module
81: Baseband section
82: RF section
821: Dielectric filter

84: Antenna

85: Wireless communication device

The invention claimed is:

1. A coaxial resonator, comprising:

a first outer conductor connected to a reference potential;

a dielectric block which is a dielectric body having a rectangular parallelepiped shape, the dielectric block being provided with a through hole formed so as to pass therethrough from a first side surface to a second side surface opposed to the first side surface of the dielectric block, and being so disposed that a first main surface of the dielectric block abuts on the first outer conductor;

an inner conductor disposed in an inside of the through hole; and a second outer conductor with a rectangular box shape having one face which is opened toward the first outer conductor, the second outer conductor having an inside dimension such that the dielectric block is housed therein so as to be spaced from a second main surface of the dielectric block, a third side surface of the dielectric block, and a fourth side surface of the dielectric block, and being connected to the reference potential, wherein the second main surface, the third side surface, and the fourth side surface are conductor-free surfaces.

2. The coaxial resonator according to claim 1, wherein the inner conductor is so disposed that its center is situated closer to the second main surface beyond a position midway between the first main surface and the second main surface.

3. A dielectric filter, comprising:

the coaxial resonator according to claim 1, comprising a plurality of the inner conductors, the inner conductors being spaced apart in a row in a direction from the third side surface to the fourth side surface; and terminal electrodes electrically or electromagnetically connected to an inner conductor on a third side surface side and an inner conductor on a fourth side surface side, respectively, the inner conductor on the third side surface side and the inner conductor on the fourth side surface side each being an endmost conductor of the row.

4. The dielectric filter according to claim 3, wherein the dielectric block is formed with slits that are located between the inner conductor on the third side surface side and the third side surface, and between the inner conductor on the fourth side surface side and the fourth side surface, respectively.

5. The dielectric filter according to claim 3, wherein the dielectric block is so shaped that, in a direction from the first side surface to the second side surface, a distance between the first main surface and the second main surface at at least one of opposite ends of the dielectric block is greater than a distance between the first main surface and the second main surface at a midportion of the dielectric block.

6. A wireless communication module, comprising:

an RF section including the dielectric filter according to claim 3; and a baseband section connected to the RF section.

7. A wireless communication device, comprising:

the wireless communication module according to claim 6; and an antenna connected to the RF section of the wireless communication module.

* * * * *